US008821196B2

(12) United States Patent
Blasick et al.

(10) Patent No.: US 8,821,196 B2
(45) Date of Patent: Sep. 2, 2014

(54) SOCKET CONTACT

(75) Inventors: Francis John Blasick, Halifax, PA (US); Alan Bucher, Manheim, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 213 days.

(21) Appl. No.: 13/407,080

(22) Filed: Feb. 28, 2012

(65) Prior Publication Data

US 2013/0225015 A1 Aug. 29, 2013

(51) Int. Cl.
*H01R 11/22* (2006.01)

(52) U.S. Cl.
USPC ..... 439/851

(58) Field of Classification Search
USPC ..... 439/842–843, 851, 856–857
See application file for complete search history.

(56) References Cited

U.S. PATENT DOCUMENTS

| | | | | |
|---|---|---|---|---|
| 4,734,064 | A * | 3/1988 | Knapp et al. | 439/852 |
| 4,906,212 | A | 3/1990 | Mixon, Jr. | |
| 5,067,916 | A | 11/1991 | Denlinger et al. | |
| 5,082,462 | A * | 1/1992 | Oswald, Jr. | 439/851 |
| 5,135,403 | A | 8/1992 | Rinaldi | |
| 5,362,244 | A | 11/1994 | Hansen et al. | |
| 5,509,814 | A | 4/1996 | Mosquera | |
| 5,938,487 | A | 8/1999 | Henry et al. | |
| 6,086,434 | A * | 7/2000 | Rollero et al. | 439/852 |
| 6,190,215 | B1 | 2/2001 | Pendleton et al. | |
| 6,250,974 | B1 * | 6/2001 | Kerek | 439/843 |
| 7,198,509 | B2 | 4/2007 | Takasu | |
| 7,845,992 | B2 | 12/2010 | Glick et al. | |

* cited by examiner

*Primary Examiner* — Xuong Chung Trans

(57) ABSTRACT

A radio frequency (RF) socket contact is provided for mating with an RF mating pin. The RF socket contact includes a body having a base that extends a length along a central longitudinal axis. The body has an odd number of cantilevered deflectable beams that extend lengths outward from the base along the central longitudinal axis. The beams define a socket therebetween that is configured to receive the RF mating pin therein. The beams include a mating zone within the socket where the beams mate with the RF mating pin. The body of the socket contact is configured to conduct radio waves.

18 Claims, 6 Drawing Sheets

SOCKET CONTACT

BACKGROUND OF THE INVENTION

The subject matter described and/or illustrated herein relates generally to socket contacts.

Socket contacts are known for mating with mating pins. A socket contact includes a socket that receives the mating pin therein. When the mating pin is received within the socket, arms of the socket contact engage the mating pin to establish an electrical connection between the socket contact and the mating pin.

Socket contacts are not without disadvantages. For example, at least some known socket contacts are fabricated using a screw machine process wherein the socket contact is machined out of a solid rod of material. However, a relatively large amount of scrap material may be generated using a screw machine process, which may increase a cost of fabricating the socket contact, for example. Screw machine processes may also be relatively time consuming, which may limit the number of socket contacts that can be fabricated within a given amount of time. The relatively time-consuming nature of fabricating socket contacts using a screw machine process may increase fabrication costs of socket contacts.

At least some other known socket contacts are fabricated using a cut and formed process, wherein the socket contact is cut (e.g., stamped) from a material and then formed to include the finished shape of the body. Some known socket contacts that are fabricated using a cut and formed process include only two arms that engage the mating pin. But, when a socket contact is provided with only two arms, the arms may be relatively long and may thereby occupy more space than is desired. Other known socket contacts that are fabricated using a cut and formed process have four arms that engage the mating pin. However, when four arms are provided, the arms may be relatively narrow and therefore relatively fragile.

There is a need for a socket contact having an efficient structure that can be manufactured in relatively high volume at relatively low cost.

BRIEF DESCRIPTION OF THE INVENTION

In one embodiment, a radio frequency (RF) socket contact is provided for mating with an RF mating pin. The RF socket contact includes a body having a base that extends a length along a central longitudinal axis. The body has an odd number of cantilevered deflectable beams that extend lengths outward from the base along the central longitudinal axis. The beams define a socket therebetween that is configured to receive the RF mating pin therein. The beams include a mating zone within the socket where the beams mate with the RF mating pin. The body of the socket contact is configured to conduct radio waves.

In another embodiment, a socket contact is provided for mating with a cylindrical mating pin. The socket contact includes a cut and formed body having a base that extends a length along a central longitudinal axis. The cut and formed body has cantilevered deflectable beams that extend lengths outward from the base along the central longitudinal axis. The beams define a socket therebetween that is configured to receive the mating pin therein. The beams include a mating zone within the socket where the beams mate with the mating pin. The mating zone of the beams is defined by curved interior surfaces of the beams that extend along arcs around the central longitudinal axis. The arcs of the curved interior surfaces of the beams include radiuses of curvature that are greater than a radius of curvature of the mating pin.

In another embodiment, a socket contact for mating with a cylindrical mating pin includes a base extending a length along a central longitudinal axis. Cantilevered deflectable beams extend lengths outward from the base along the central longitudinal axis. The beams define a socket therebetween that is configured to receive the mating pin therein. The beams include a mating zone within the socket where the beams mate with the mating pin. The mating zone is defined by curved interior surfaces of the beams that extend along arcs around the central longitudinal axis. An arc length of the interior surface of at least one of the beams is different than an arc length of the interior surface of at least one other of the beams.

DETAILED DESCRIPTION OF THE INVENTION

Figure 1:
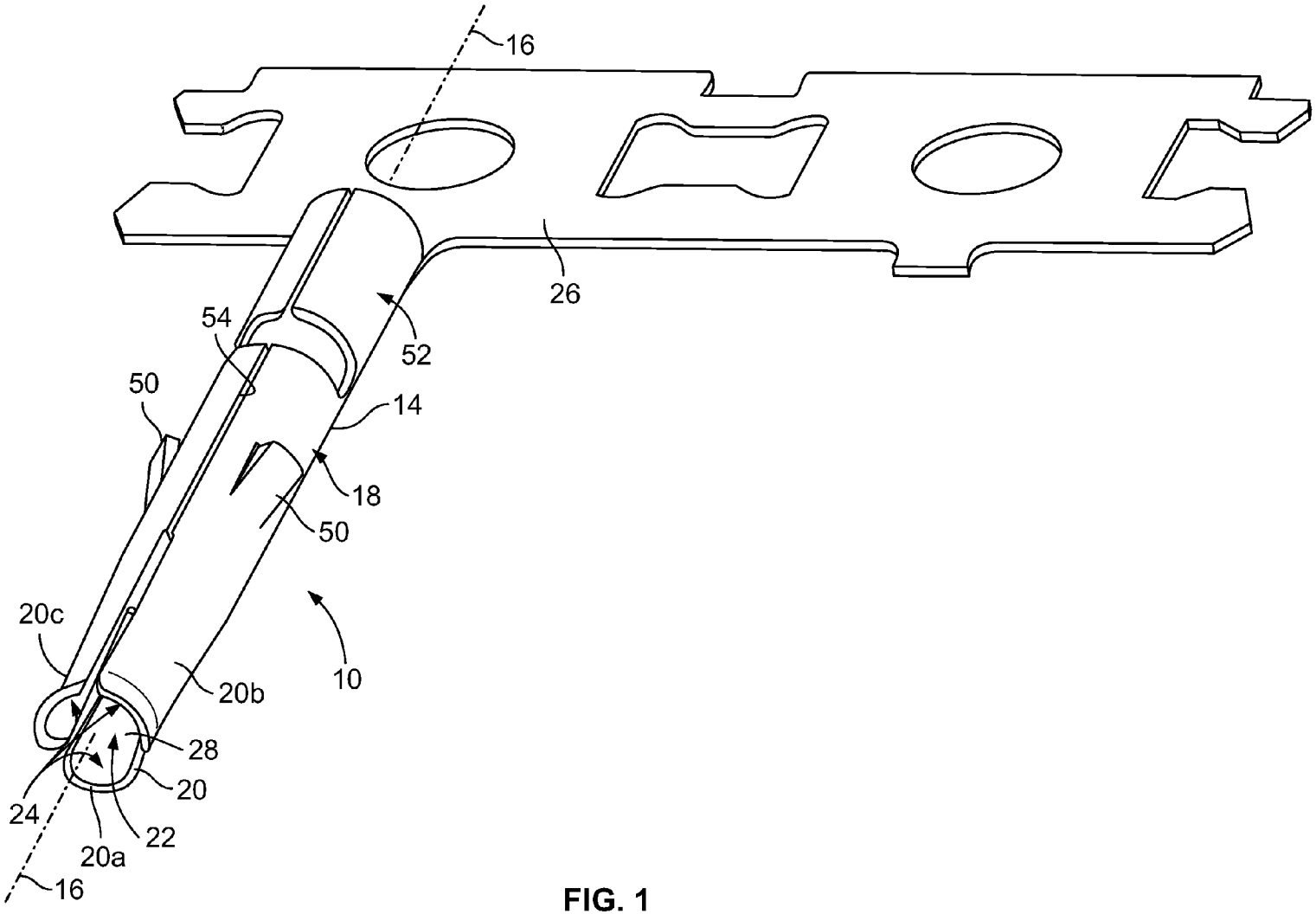
FIG. 1 is a perspective view of an exemplary embodiment of a socket contact.
Figure 2:
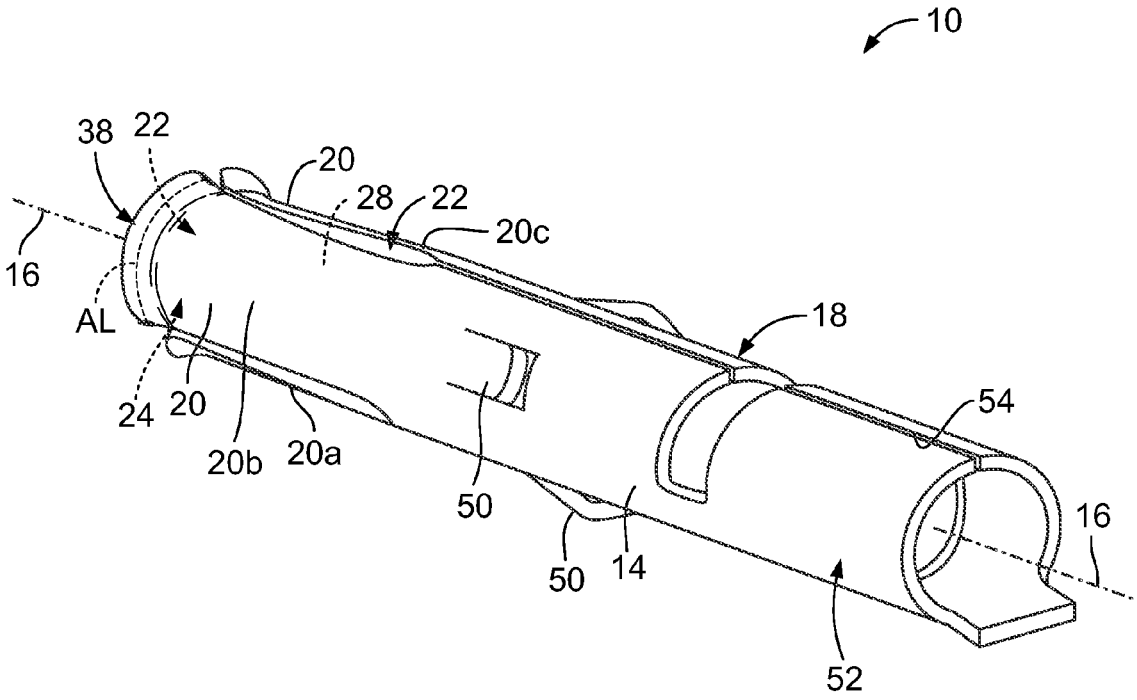
FIG. 2 is a perspective view of the socket contact shown in FIG. 1 viewed from a different angle than FIG. 1.

FIG. 1 is a perspective view of an exemplary embodiment of a socket contact 10. FIG. 2 is a perspective view of the socket contact 10 viewed from a different angle than FIG. 1. Referring now to FIGS. 1 and 2, the socket contact 10 is configured to mate with a mating pin 12 (FIGS. 5 and 7) to establish an electrical connection between the socket contact 10 and the mating pin 12. The socket contact 10 includes an electrically conductive body 14 that extends a length along a central longitudinal axis 16. The body 14 includes a base 18 and cantilevered deflectable beams 20 that extend from the base 18. A socket 22 is defined between the beams 20 for receiving the mating pin 12 therein. When the mating pin 12 is received within the socket 22, the beams 20 mate with the mating pin 12 at a mating zone 24 of the socket contact 10 to electrically connect the mating pin 12 to the body 14 of the socket contact 10. FIG. 1 illustrates the socket contact 10 attached to an optional carrier strip 26 that is optionally used during fabrication of a plurality of the socket contacts 10. FIG. 2 illustrates the socket contact 10 after the socket contact 10 has been removed from the carrier strip 26.

The socket contact 10 may be implemented in any type of connector for use interconnecting any type(s) of electrical components. In some embodiments, the socket contact 10 is configured for use as a component of a coaxial connector and/or a radio frequency (RF) connector, such as, but not limited to N connectors, BNC connectors, TNC connectors, ETNC connectors, SMA connectors, SMB connectors, SMC connectors, F connectors, and/or the like. For example, the body 14 of the socket contact 10 may be configured to conduct radio waves such that the socket contact 10 is an RF socket contact that may be used within an RF connector. The socket contact 10 may be referred to herein as a "radio frequency (RF) socket contact".

Figure 3:
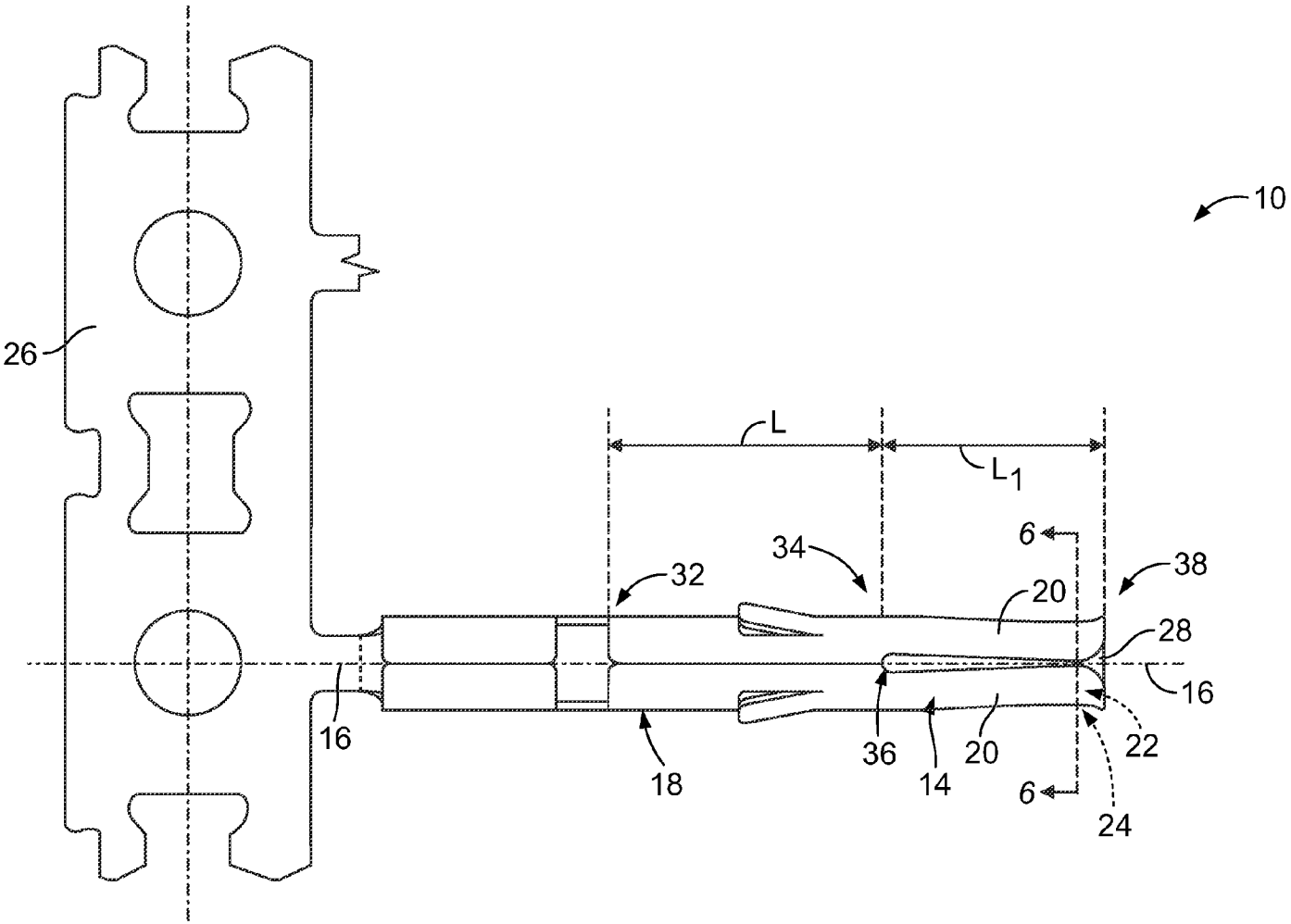
FIG. 3 is a top plan view of the socket contact shown in FIGS. 1 and 2.

FIG. 3 is a top plan view of the socket contact 10. FIG. 3 illustrates the socket contact 10 attached to the carrier strip 26. In the exemplary embodiment, the body 14 of the socket contact 10 has a generally tubular shape. The base 18 of the body 14 extends a length L along the central longitudinal axis 16 from an end 32 to an opposite end 34. The beams 20 extend lengths $L_1$ outward from the base 18 along the central longitudinal axis 16. Slots 36 are defined between adjacent beams 20. Each beam 20 extends the length $L_1$ from the end 34 of the base 18 to a tip end 38 of the beam 20. While the beams 20 are fixed to the base 18 at the end 34 of the base 18, the tip ends 38 of the beams 20 are free relative to the base 18, such that the beams 20 are cantilevered from the base 18. The socket 22 of the body 14 that receives the mating pin 12 (FIGS. 5 and 7) is defined between the beams 20. Specifically, the socket 22 is defined between the interior surfaces 28 of the beams 20.

As briefly described above, each of the beams 20 is a deflectable spring. The undeflected (i.e., natural resting) positions of the beams 20 are shown in FIG. 3. The tip end 38 of each beam 20 is configured to be deflected radially outward (relative to the central longitudinal axis 16) away from the undeflected position and against a bias of the beam 20 toward the undeflected position. Specifically, as the mating pin 12 is received into the socket 22, the mating pin 12 engages the interior surfaces 28 of the beams 20 at the mating zone 24 and deflects the beams 20 radially outward away from the undeflected positions. When deflected via engagement with the mating pin 12, each beam 20 may bend at the corresponding intersection with the base 18 and/or may bend at any location (s) along the length of the beam 20.

Figure 4:
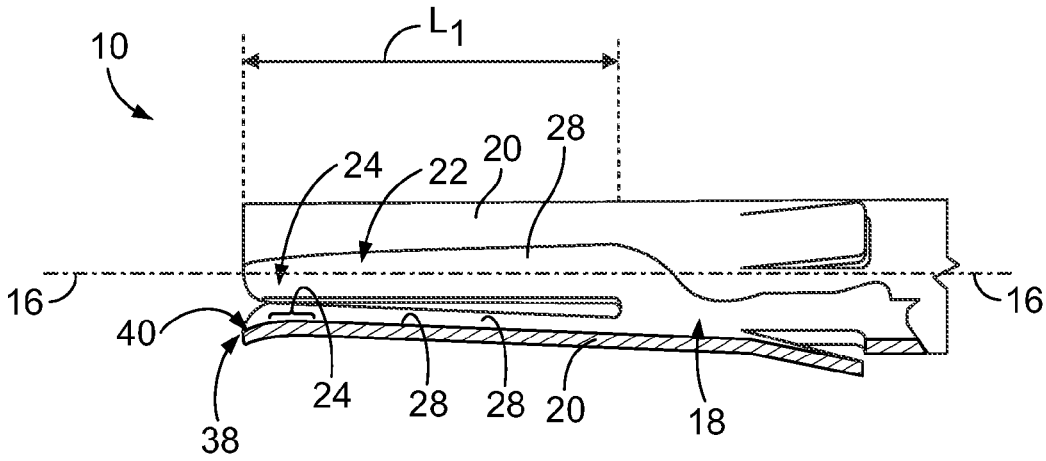
FIG. 4 is a partially broken-away perspective view of the socket contact shown in FIGS. 1-3 illustrating a cross section of an exemplary embodiment of a beam of the socket contact.
Figure 5:
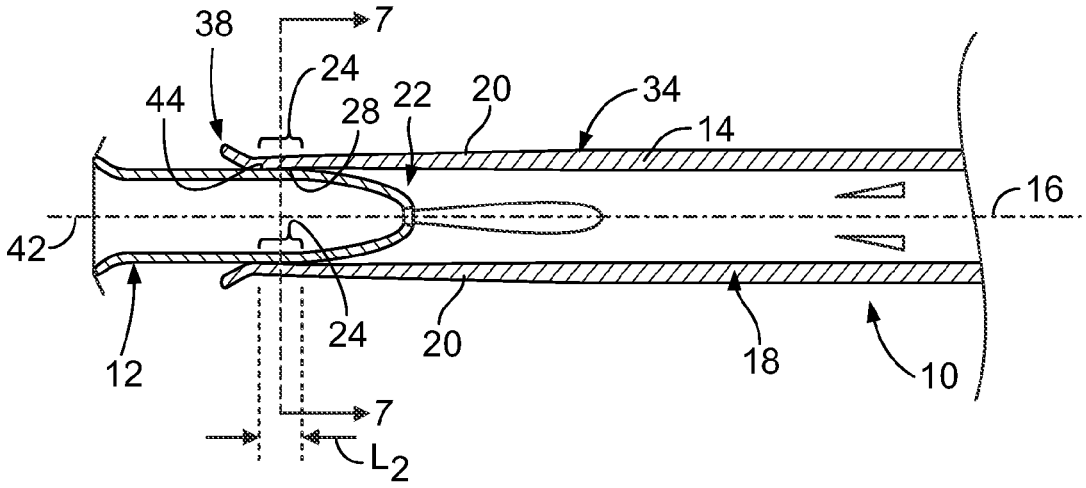
FIG. 5 is a cross-sectional view of the socket contact shown in FIGS. 1-4 illustrating an exemplary mating pin mated with the socket contact.
Figure 7:
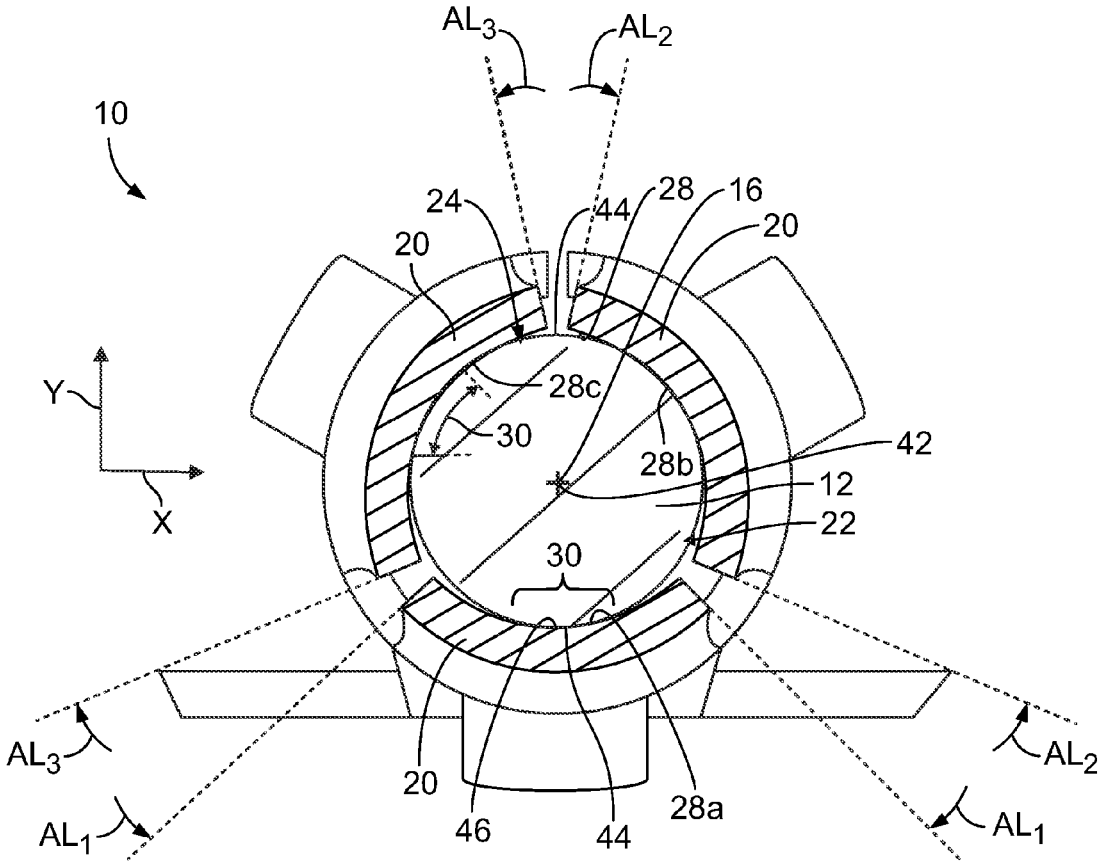
FIG. 7 is another cross-sectional view of the socket contact taken along line 7-7 of FIG. 5 and illustrating the exemplary mating pin mated with the socket contact.

FIG. 4 is a partially broken-away perspective view of the socket contact 10 illustrating a cross section of one of the beams 20 of the socket contact 10. The beams 20 are shown in the undeflected position in FIG. 4. In the undeflected position, the beams 20 converge radially inward toward the central longitudinal axis 16 as the beams 20 extend the lengths $L_1$ from the base 18 toward the tip ends 38. Specifically, the interior surfaces 28 of the beams 20 slope radially inward along a portion of the lengths $L_1$ of the beams 20 as the beams 20 extend outward from the base 18. The beams 20 converge to the mating zone 24. When the beams 20 are in the undeflected position, at least a portion of the mating zone 24 of the socket 22 may have a size that is generally smaller than the size of the mating pin 12 (FIGS. 5 and 7). As the mating pin 12 is received into the socket 22, the mating pin 12 engages the interior surfaces 28 of the beams 20 at the mating zone 24 and deflects the tip ends 38 of the beams 20 radially outward.

As can be seen in FIG. 4, the interior surfaces 28 of the beams 20 are flared outward at the tip ends 38. Specifically, the interior surfaces 28 are sloped radially outward (relative to the central longitudinal axis 16) at the tip ends 38 of the beams 20. The outward flare of the interior surfaces 28 defines a guide section 40 of the socket 22 that facilitates guiding the mating pin 12 into the socket 22. For example, as the mating pin 12 is received into the socket 22, the guide section 40 of the socket 22 facilitates aligning a central longitudinal axis 42 (FIG. 5) of the mating pin 12 with the central longitudinal axis 16 of the socket contact 10. Optionally, the tip ends 38 have a reduced arc length AL (FIG. 2) relative to the remainder of the length of the corresponding beam 20.

FIG. 5 is a cross-sectional view of the socket contact 10 illustrating the mating pin 12 mated with the socket contact 10. FIG. 5 illustrates the beams 20 in an exemplary embodiment of a deflected position. The mating pin 12 is received in the socket 22 such that the central longitudinal axis 42 of the mating pin 12 is aligned with the central longitudinal axis 16 of the socket contact 10. An exterior surface 44 of the mating pin 12 is engaged with the interior surfaces 28 of the beams 20 at the mating zone 24. The engagement between the exterior surface 44 of the mating pin 12 and the interior surfaces 28 of the beams 20 electrically connects the body 14 of the socket contact 10 to mating pin 12.

Figure 6:
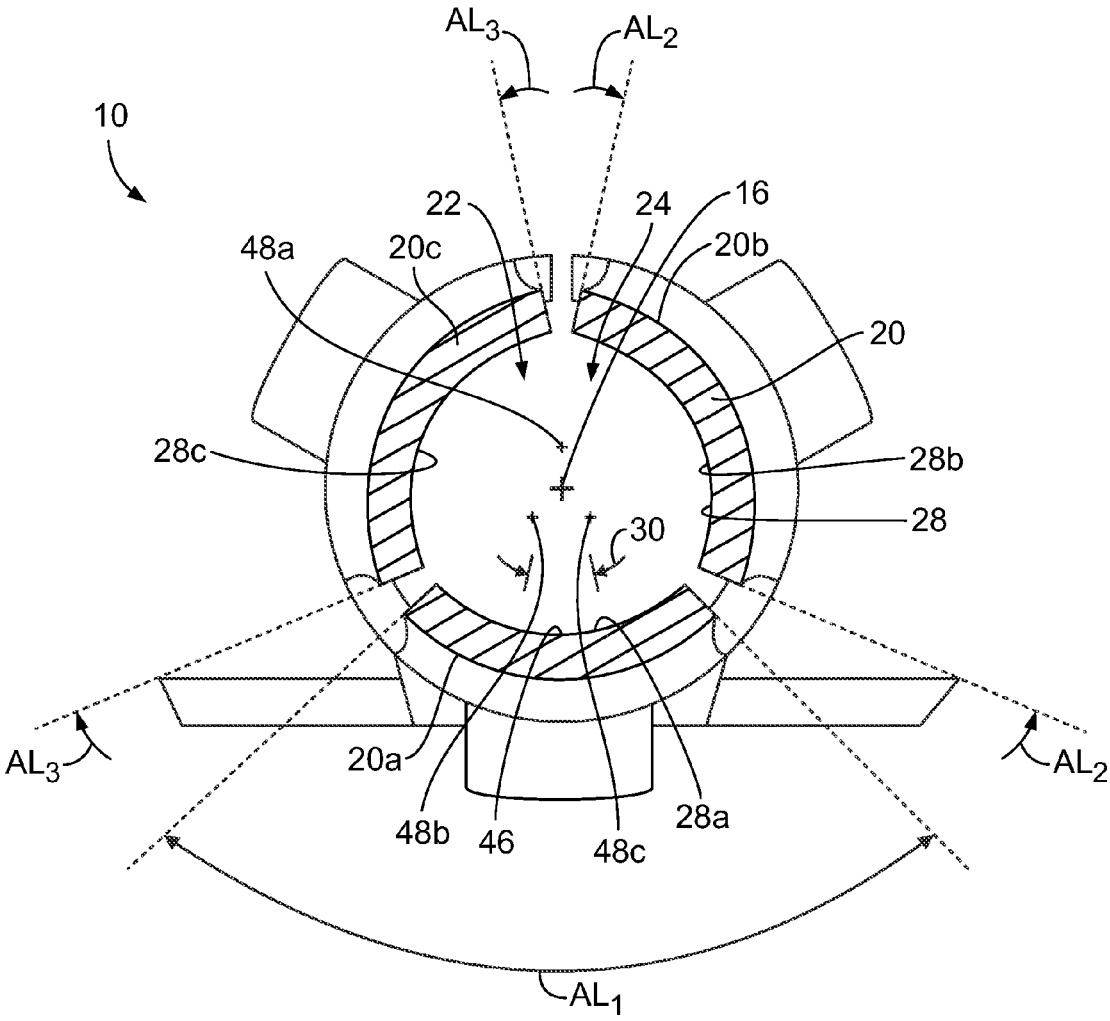
FIG. 6 is a cross-sectional view of the socket contact shown in FIGS. 1-5 taken along line 6-6 of FIG. 3.

FIG. 6 is a cross-sectional view of the socket contact 10 taken along line 6-6 of FIG. 3. FIG. 6 illustrates a cross section of the mating zone 24 of the socket contact 10. As can be seen in FIG. 3, the cross section of FIG. 6 is taken approximately perpendicular to the central longitudinal axis 16. In FIG. 6, the beams 20 are shown in the undeflected positions wherein the socket contact 10 is not mated with the mating pin 12 (FIGS. 5 and 7). As briefly described above, the interior surfaces 28 of the beams 20 are curved in the exemplary embodiment. Specifically, and as can be seen in FIG. 6, the interior surfaces 28 extend along arcs around the central longitudinal axis 16. In the exemplary embodiment, the socket contact 10 has three beams 20*a*, 20*b*, and 20*c*, which include respective interior surfaces 28*a*, 28*b*, and 28*c*. Each of the interior surfaces 28*a*, 28*b*, and 28*c* includes a respective arc length $AL_1$, $AL_2$, and $AL_3$ having the corresponding middle segment 30, which includes a midpoint 46. The interior surfaces 28 are curved along at least a portion of the lengths $L_1$ (FIG. 3) of the beams 20 (e.g., at least along the mating zone 24). Each of the beams 20*a*, 20*b*, and 20*c* may be referred to herein as a "first", a "second", and/or a "third" beam.

In the exemplary embodiment, the socket contact 10 is configured to mate with a mating pin 12 having a cylindrical shape, for example the mating pin 12. Specifically, the socket 22 is configured to receive, and the mating zone 24 is configured to mate with, a mating pin having a cylindrical shape. A mating pin (e.g., the mating pin 12) having a cylindrical shape may be referred to herein as a "cylindrical mating pin" and/or an "RF mating pin".

Optionally, one or more of the arc lengths $AL_1$, $AL_2$, and/or $AL_3$ has a different dimension than one or more other arc lengths $AL_1$, $AL_2$, and/or $AL_3$. For example, in some embodiments, one or more of the arc lengths $AL_1$, $AL_2$, and/or $AL_3$ is shorter than one or more other arc lengths $AL_1$, $AL_2$, and/or $AL_3$. In the exemplary embodiment, the arc lengths $AL_2$ and $AL_3$ of the interior surfaces 28*b* and 28*c* of the beams 20*b* and 20*c*, respectively, are approximately the same, while the arc length $AL_1$ of the interior surface 28*a* of the beam 20*a* is shorter than the arc lengths $AL_2$ and $AL_3$.

The relative dimensions of the arc lengths $AL_1$, $AL_2$, and/or $AL_3$ may be selected to accommodate a structural asymmetry of the body 14 of the socket contact 10. For example, a seam 54 of the body 14 may provide the body 14 with a structural asymmetry. Any relative dimensions of the arc lengths $AL_1$, $AL_2$, and/or $AL_3$ may be selected to accommodate a structural asymmetry of the body 14 of the socket contact 10 and may depend on the size (e.g., length, width, and/or the like) and/or location of the seam 54, the number, size (e.g., length, width, and/or the like), relative location, and/or spacing between the beams 20, and/or the like. In some embodiments, to accommodate a structural asymmetry, the relative dimensions of the arc lengths $AL_1$, $AL_2$, and/or $AL_3$ are selected such that each beam 20*a*, 20*b*, and 20*c* exerts an approximately equal force on the mating pin 12 when the beams 20 are deflected via engagement with the mating pin 12 (i.e., when the socket contact 10 and the mating 12 are mated together). If the forces exerted by the beams 20*a*, 20*b*, and 20*c* on the mating pin 12 are not approximately equal, the central longitudinal axis 42 (FIGS. 5 and 7) of the mating pin 12 may shift relative to the central longitudinal axis 16 of the socket contact 10 during mating of the socket contact 10 and the mating pin 12.

In the exemplary embodiment, the arc length $AL_1$ of the interior surface 28*a* of the beam 20*a* that extends opposite the seam 54 has a shorter dimension than the arc lengths $AL_2$ and $AL_3$ of the interior surfaces 28*b* and 28*c* of the beams 20*b* and 20*c*, respectively, that extend adjacent the seam 54. In the exemplary embodiment, the shorter dimension of the arc length $AL_1$ of the interior surface 28*a* of the beam 20*a* relative to the approximately equal dimensions of the arc lengths $AL_2$ and $AL_3$ may provide the socket contact body 14 with a structure wherein each beam 20*a*, 20*b*, and 20*c* exerts an approximately equal force on the mating pin 12 when the beams 20 are deflected via engagement with the mating pin 12. In the exemplary embodiment, the arc length $AL_1$ of the interior surface 28*a* of the beam 20*a* has an included angle of approximately 92°, the arc lengths $AL_2$ and $AL_3$ have included angles of approximately 104°, the seam 54 has a width of approximately 0.05 mm, and the spacing between adjacent beams 20 is an included angle of approximately 20°. But, the beams 20*a*, 20*b*, and 20*c* are not limited to the exemplary included angles, nor is the width of the seam 54 or the spacing between adjacent beams 20 limited to the exemplary dimensions. Rather, each of the arc lengths $AL_1$, $AL_2$, and $AL_3$ may have any other dimension, whether or not the dimensions accommodate a structural asymmetry of the body 14 of the socket contact 10. Moreover, each of the arc lengths $AL_1$, $AL_2$, and $AL_3$ may have any other dimension relative to any of the other arc lengths $AL_1$, $AL_2$, and/or $AL_3$, whether or not the dimensions accommodate a structural asymmetry of the body 14 of the socket contact 10. The seam 54 may have any other width and adjacent beams 20 may be spaced apart by any other dimension.

As can be seen in FIG. 6, the interior surfaces 28 of the beams 20 are optionally arranged relative to each other such that the socket 22 has a non-circular cross-sectional shape at the mating zone 24. Specifically, the arcs of the interior surfaces 28 of the beams 20 are not concentrically aligned with each other. Rather, centers 48*a*, 48*b*, and 48*c* of the arcs of respective interior surfaces 28*a*, 28*b*, and 28*c* are offset from each other such that the arcs of the interior surfaces 28 are spaced closer to the central longitudinal axis 16 than if the arcs of the interior surfaces 28 were concentrically aligned.

Optionally, the arcs of the interior surfaces 28 of the beams 20 include radiuses of curvature that are greater than a radius of curvature of the mating pin 12. In the exemplary embodiment, the arcs of the interior surfaces 28 have radiuses of curvature that are continuous along the entirety of the arc lengths $AL_1$, $AL_2$, and $AL_3$ of the interior surfaces 28*a*, 28*b*, and 28*c*, respectively. But, in some alternative embodiments, the arc length $AL_1$, $AL_2$, and/or $AL_3$ includes a radius of curvature that varies and/or includes an approximately flat segment that is not curved around the axis 16.

FIG. 7 is a cross-sectional view of the socket contact 10 taken along line 7-7 of FIG. 5. FIG. 7 illustrates a cross section of the mating zone 24 of the socket contact 10 when the socket contact 10 is mated with the mating pin 12. As can be seen in FIG. 5, the cross section of FIG. 7 is taken approximately perpendicular to the central longitudinal axis 16. The mating pin 12 is received in the socket 22 such that the mating pin 12 is engaged with the interior surfaces 28 of the beams 20 at the mating zone 24. In the exemplary embodiment, three beams 20 are provided. The socket contact 10 engages the mating pin 12 at least three different points of engagement, which may facilitate aligning the mating pin 12 relative to the socket contact 10 along both X and Y axes.

In the exemplary embodiment, the exterior surface 44 of the mating pin 12 engages the interior surfaces 28 of the beams 20 at the middle segments 30 of the arc lengths $AL_1$, $AL_2$, and $AL_3$ of the interior surfaces 28*a*, 28*b*, and 28*c*, respectively. The mating pin 12 engages the approximate midpoints 46 of the arc lengths $AL_1$, $AL_2$, and $AL_3$. As can be seen in FIG. 7, the middle segment 30 of the arc lengths $AL_1$, $AL_2$, and $AL_3$ of each of the interior surfaces 28*a*, 28*b*, and 28*c*, respectively, has a radius of curvature that is greater than a radius of curvature of the mating pin 12. In the exemplary embodiment, the beams 20 only engage the mating pin 12 at the middle segments 30 of the arc lengths $AL_1$, $AL_2$, and $AL_3$ of the interior surfaces 28*a*, 28*b*, and 28*c*, respectively; for example because the radius of curvature of each interior surface 28 is a continuous radius of curvature that is greater than the radius of curvature of the mating pin 12.

Although shown and described herein as only engaging the mating pin 12 at the middle segments 30 of the arc lengths $AL_1$, $AL_2$, and $AL_3$ of the interior surfaces 28*a*, 28*b*, and 28*c*, respectively, each beam may additionally or alternatively engage the exterior surface 44 of the mating pin 12 at any other location(s) along the arc lengths $AL_1$, $AL_2$, and $AL_3$ of the interior surfaces 28*a*, 28*b*, and 28*c*, respectively.

Referring again to FIGS. 1 and 2, the socket contact 10 may include any number of the beams 20. In some embodiments, the socket contact 10 has an odd number of the beams 20. For example, the socket contact 10 has three beams 20*a*, 20*b*, and 20*c* in the exemplary embodiment.

The base 18 of the socket contact 10 optionally includes one or more locking tabs 50 extending outwardly. The locking tabs 50 may be deflectable and are used to secure the socket contact 10 to a housing (not shown) or dielectric insert (not shown) of a connector (not shown) within which the socket contact 10 is used. The body 14 of the socket contact 10 includes a tail 52. The tail 52 may be configured to terminate an electrical conductor (not shown) of an electrical wire (not shown), such as, but not limited to, a coaxial cable. Alternatively, the tail 52 may be configured to be received within a via (not shown) of a circuit board (not shown). The tail 52 may be bent to extend at any angle relative to the central longitudinal axis 16. When configured to terminate an electrical conductor of an electrical cable, the tail 52 may be terminated to the electrical conductor in a variety of ways, such as, but not limited to, being crimped to the electrical conductor, being soldered to the electrical conductor, using indenting, using lancing, using active beam termination, using an insulation displacement connection, and/or the like.

The body 14 of the socket contact 10 may be fabricated from any material(s) that enable the body 14 to be electrically conductive. The body 14 of the socket contact 10 may be fabricated using any method, process, structure, means, and/or the like, such as, but not limited to, using a cutting process, using a casting process, using a molding process, using a forming process, and/or the like. Cutting processes include, but are not limited to, water cutting, stamping, laser cutting, punching, cutting using a saw, drill bit, plane, mill, and/or other solid cutting tool, and/or the like. Forming processes include, but are not limited to, drawing, bending, and/or the like. When the body 14 is fabricated using a cutting process, the body 14 of the socket contact 10 may be cut from a reel of material, from a blank of material, from an approximately flat sheet of material, from an approximately flat material, from a rod of material, and/or the like.

In some embodiments, the body 14 of the socket contact 10 is a cut and formed body that is cut from a material and then formed to include the shape (e.g., the exemplary tubular shape) of the body 14. For example, various cuts may be made to the material to define the body 14 of the socket contact 10 from the material. Examples of such cuts include cutting an initial shape of the tail 52, the base 18, and/or the beams 20 (e.g., cutting the slots 36 to separate adjacent beams 20 from each other and to partially define the shapes of the beams 20). Other features of the socket contact 10 that may be cut from the material include the locking tabs 50. Once the material has been cut, the material may be formed to define the finished shapes of the tail 52, the base 18, the beams 20, and/or other features of the socket contact 10. For example, the body 14 may be formed to include the exemplary tubular shape shown herein, which may provide the beams 20 with the curved interior surfaces 28. Moreover, and for example, the beams 20 may be bent to converge to the mating zone 24 and/or the locking tabs 50 may be bent to extend outwardly. When cut and formed to include the exemplary tubular shape shown herein, the finished shape of the body 14 may include the seam 54. Cut and formed contacts may be less expensive to fabricate than machined contacts. In some embodiments, the body 14 is a cut and drawn body that is cut from a material and then drawn to form the finished shape of the body 14. The body 14 of the socket contact 10 is a stamped and formed body that is stamped from a material and then formed to include the finished shape of the body 14 in some embodiments.

Although shown with the exemplary tubular shape, the body 14 of the socket contact 10 may additionally or alternatively include any other shape(s). Moreover, the socket contact 10 is not limited to being used with a cylindrical mating pin. Rather, the socket 22 and mating zone 24 of the socket contact 10 may be configured to mate with a mating pin that includes any other shape(s) in addition or alternatively to the cylindrical shape.

Referring again to FIG. 5, in the exemplary embodiment, the mating zone 24 extends along a relatively small segment of the lengths $L_1$ of the beams 20. For example, the mating zone 24 has a length $L_2$ that extends along approximately less than 10% of the lengths $L_1$ of the beams 20 in the exemplary embodiment. But, the length $L_2$ of the mating zone 24 may have any dimension, which may be any amount of the lengths $L_1$ of the beams 20. Moreover, the mating zone 24 extends adjacent the tip ends 38 of the beams 20 in the exemplary embodiment. But, the mating zone 24 may additionally or alternatively extend at any other location(s) along the lengths $L_1$ of the beams 20. In the exemplary embodiment, the beams 20 still converge radially inward toward the central longitudinal axis 16, albeit by a lesser amount, in the deflected position (i.e., when the mating pin 12 is mated with the socket contact 10). But, in some alternative embodiments, the interior surfaces 28 of the beams 20 are approximately parallel to the central longitudinal axis 16 or flare radially outward relative to the axis 16 when the mating pin 12 is mated with the socket contact 10. The dimension of the length $L_2$ of the mating zone 24 along the lengths $L_1$ of the beams 20, the amount of the lengths $L_1$ of the beams 20 along which the mating zone 24 extends, the location(s) of the mating zone 24 along the lengths $L_1$ of the beams 20, and/or the orientation of the interior surfaces 28 relative to the central longitudinal axis 16 when the pin 12 and contact 10 are mated together may depend on the relative size between the mating pin 12 and the socket 22 when the beams 20 are in the undeflected positions and/or the deflected positions.

The embodiments described and/or illustrated herein may provide a socket contact having an efficient structure that can be manufactured in relatively high volume at relatively low cost. The embodiments described and/or illustrated herein may provide a socket contact that can be fabricated using a reduced amount of raw material, that generates less scrap material during fabrication thereof, and/or that can be fabricated in a reduced amount of time. The embodiments described and/or illustrated herein may provide a socket contact having deflectable beams that occupy less space and/or are less fragile than the deflectable beams of at least some known socket contacts. For example, the embodiments described and/or illustrated herein may provide a socket contact that is fabricated using a cut and formed process and that includes deflectable beams that occupy less space and/or are less fragile than the deflectable beams of at least some known socket contacts that are fabricated using a cut and formed process. The embodiments described and/or illustrated herein may provide a socket contact that is fabricated using a cut and formed process and that has an odd number (e.g., three) of deflectable beams. The embodiments described and/or illustrated herein may provide an RF socket contact that is configured to conduct radio waves and that has an odd number (e.g., three) of deflectable beams. The embodiments described and/or illustrated herein may provide a socket contact having deflectable beams that include curved interior surfaces that extend along arcs and that have radiuses of curvature that are greater than a radius of curvature of a mating pin. The embodiments described and/or illustrated herein may provide a socket contact having deflectable beams that include curved interior surfaces that extend along arcs, wherein an arc length of the interior surface of at least one of the beams is different than an arc length of the interior surface of at least one other of the beams. The embodiments described and/or illustrated herein may provide a socket contact having deflectable beams that only engage a mating pin at middle segments of arcs of the curved interior surfaces of the deflectable beams.

Exemplary embodiments are described and/or illustrated herein in detail. The embodiments are not limited to the specific embodiments described herein, but rather, components and/or steps of each embodiment may be utilized independently and separately from other components and/or steps described herein. Each component, and/or each step of one embodiment, can also be used in combination with other components and/or steps of other embodiments. When introducing elements/components/etc. described and/or illustrated herein, the articles "a", "an", "the", "said", and "at least one" are intended to mean that there are one or more of the element(s)/component(s)/etc. The terms "comprising", "including" and "having" are intended to be inclusive and mean that there may be additional element(s)/component(s)/etc. other than the listed element(s)/component(s)/etc. Moreover, the terms "first," "second," and "third," etc. in the claims are used merely as labels, and are not intended to impose numerical requirements on their objects. Dimensions, types of materials, orientations of the various components, and the number and positions of the various components described and/or illustrated herein are intended to define parameters of certain embodiments, and are by no means limiting and are merely exemplary embodiments. Many other embodiments and modifications within the spirit and scope of the claims will be apparent to those of skill in the art upon reviewing the description and illustrations. The scope of the subject matter described and/or illustrated herein should therefore be determined with reference to the appended claims, along with the full scope of equivalents to which such claims are entitled. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

While the subject matter described and/or illustrated herein has been described in terms of various specific embodiments, those skilled in the art will recognize that the subject matter described and/or illustrated herein can be practiced with modification within the spirit and scope of the claims.

What is claimed is:

1. A radio frequency (RF) socket contact for mating with an RF mating pin, the RF socket contact comprising a body having a base that extends a length along a central longitudinal axis, the body having three cantilevered deflectable beams that extend lengths outward from the base along the central longitudinal axis, the beams defining a socket therebetween that is configured to receive the RF mating pin therein, the beams comprising a mating zone within the socket where the beams mate with the RF mating pin, wherein the body of the socket contact is configured to conduct radio waves, wherein the mating zone of the beams is defined by curved interior surfaces of the beams that extend along arcs around the central longitudinal axis, wherein the arcs of the curved interior surfaces of the beams comprise radiuses of curvature that are greater than a radius of curvature of the RF mating pin.

2. The RF socket contact of claim 1, wherein the body is a cut and formed body.

3. The RF socket contact of claim 1, wherein the body is configured to be used as a component of at least one of a coaxial connector or an RF connector.

4. A socket contact for mating with a cylindrical mating pin, the socket contact comprising a cut and formed body having a base that extends a length along a central longitudinal axis, the cut and formed body having cantilevered deflectable beams that extend lengths outward from the base along the central longitudinal axis, the beams defining a socket therebetween that is configured to receive the mating pin therein, the beams comprising a mating zone within the socket where the beams mate with the mating pin, the mating zone of the beams being defined by curved interior surfaces of the beams that extend along arcs around the central longitudinal axis, wherein the arcs of the curved interior surfaces of the beams comprise radiuses of curvature that are greater than a radius of curvature of the mating pin.

5. The socket contact of claim 4, wherein the curved interior surfaces of the beams are arranged relative to each other such that the socket has a non-circular cross-sectional shape at the mating zone.

6. The socket contact of claim 4, wherein the arcs of the curved interior surfaces of the beams comprise middle segments that include midpoints of the arc lengths, the middle segments of the curved interior surfaces having radiuses of curvature that are greater than the radius of curvature of the mating pin.

7. The socket contact of claim 4, wherein the body of the socket contact has an odd number of the beams.

8. The socket contact of claim 4, wherein the body of the socket contact comprises only three of the beams.

9. The socket contact of claim 4, wherein the arcs of the curved interior surfaces of the beams comprise middle segments that include the midpoint of the arc lengths, the beams being configured to only engage the mating pin at the middle segments of the curved interior surfaces.

10. The socket contact of claim 4, wherein the curved interior surfaces of the beams have continuous radiuses of curvature along the arc lengths thereof, the continuous radiuses of curvature of the curved interior surfaces being greater than the radius of curvature of the mating pin.

11. The socket contact of claim 4, wherein the beams are configured to engage the mating pin at approximate midpoints of are lengths of the curved interior surfaces.

12. A socket contact for mating with a cylindrical mating pin, the socket contact comprising:

a seam;

a base extending a length along a central longitudinal axis; and cantilevered deflectable beams extending lengths outward from the base along the central longitudinal axis, the beams defining a socket therebetween that is configured to receive the mating pin therein, the beams comprising a mating zone within the socket where the beams mate with the mating pin, the mating zone being defined by curved interior surfaces of the beams that extend along arcs around the central longitudinal axis, the beams comprising a first beam that extends opposite the seam, wherein an arc length of the interior surface of the first beam is different than an arc length of the interior surface of at least one other of the beams.

13. The socket contact of claim 12, wherein the relative dimensions of the arc lengths of the interior surfaces of the beams are configured such that the beams exert an approximately equal force on the mating pin when the beams are deflected via engagement with the mating pin.

14. The socket contact of claim 12, wherein the socket contact has an odd number of the beams.

15. The socket contact of claim 12, wherein the socket contact is a cut and formed socket contact.

16. The socket contact of claim 12, wherein the socket contact is configured to be used as a component of at least one of a coaxial connector or an RF connector.

17. The socket contact of claim 12, wherein the socket contact comprises second and third beams, the arc lengths of the interior surfaces of the second and third beams having approximately the same dimension, the arc length of the interior surface of the first beam having a shorter dimension than the arc lengths of the interior surfaces of the first and second beams.

18. The socket contact of claim 12, wherein a midpoint of the arc length of the interior surface of the first beam is aligned with the seam such that an alignment axis that extends approximately perpendicular to the central longitudinal axis extends through the seam, the central longitudinal axis, and the midpoint.

* * * * *